US009683311B2

(12) United States Patent
Bertelo et al.

(10) Patent No.: US 9,683,311 B2
(45) **Date of Patent: *Jun. 20, 2017**

(54) HIGH PERFORMANCE FIBERS

(75) Inventors: Christopher A. Bertelo, Doylestown, PA (US); Anthony Decarmine, Lebanon, CT (US)

(73) Assignee: Arkema Inc., King of Prussia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/147,434

(22) PCT Filed: Feb. 2, 2010

(86) PCT No.: PCT/US2010/022796

§ 371 (c)(1),
(2), (4) Date: Aug. 2, 2011

(87) PCT Pub. No.: WO2010/088638

PCT Pub. Date: Aug. 5, 2010

(65) Prior Publication Data

US 2011/0287255 A1 Nov. 24, 2011

Related U.S. Application Data

(60) Provisional application No. 61/149,118, filed on Feb. 2, 2009.

(51) Int. Cl.

*D04H 13/00* (2006.01)
*D01F 6/66* (2006.01)
*D01F 1/10* (2006.01)

(52) U.S. Cl.

CPC ..... *D01F 6/665* (2013.01); *D01F 1/10* (2013.01); *Y10T 428/298* (2015.01)

(58) Field of Classification Search

CPC ... D01F 6/665; B29C 70/025; C08G 2650/40; C08L 29/12; C08K 7/02; D06M 2101/00
USPC ..... 525/432; 524/447, 449, 444, 450, 592; 977/762, 961
See application file for complete search history.

(56) References Cited

U.S. PATENT DOCUMENTS

| | | | | |
|---|---|---|---|---|
| 3,065,205 | A | 11/1962 | Bonner et al. | |
| 3,441,538 | A | 4/1969 | Marks et al. | |
| 3,442,857 | A | 5/1969 | Thornton | |
| 3,516,966 | A | 6/1970 | Berr | |
| 3,519,206 | A | 7/1970 | Leaders | |
| 3,666,612 | A | 5/1972 | Angelo | |
| 3,929,164 | A | 12/1975 | Richter | |
| 4,359,501 | A | 11/1982 | DiTullio | |
| 4,704,448 | A | 11/1987 | Brugel | |
| 4,747,988 | A | 5/1988 | Deeg | |
| 4,816,556 | A | 3/1989 | Gay et al. | |
| 4,820,571 | A | 4/1989 | Searfass | |
| 4,891,084 | A | 1/1990 | Senior | |
| 4,954,605 | A | 9/1990 | Deeg | |
| 4,992,485 | A | 2/1991 | Koo et al. | |
| 4,996,287 | A | 2/1991 | Bloom | |
| 5,034,157 | A | 7/1991 | Merrell et al. | |
| 5,049,340 | A | 9/1991 | Moss et al. | |
| 5,124,413 | A | 6/1992 | Luise | |
| 5,130,408 | A | 7/1992 | Deeg | |
| 5,238,725 | A | 8/1993 | Effing et al. | |
| 5,260,104 | A | 11/1993 | Bryant et al. | |
| 5,290,906 | A | 3/1994 | Matsumura et al. | |
| 5,300,122 | A * | 4/1994 | Rodini | 8/607 |
| 5,409,757 | A | 4/1995 | Muzzy et al. | |
| 5,470,639 | A | 11/1995 | Gessner et al. | |
| 5,601,893 | A | 2/1997 | Strassel et al. | |
| 5,667,146 | A | 9/1997 | Pimentel et al. | |
| 5,730,188 | A | 3/1998 | Kalman et al. | |
| 5,997,989 | A | 12/1999 | Gessner et al. | |
| 6,004,160 | A | 12/1999 | Korsunsky et al. | |
| 6,132,872 | A | 10/2000 | McIntosh et al. | |
| 6,177,518 | B1 | 1/2001 | Lahijani | |
| 6,383,623 | B1 | 5/2002 | Erb, Jr. | |
| 6,668,866 | B2 | 12/2003 | Glejbol et al. | |
| 6,689,835 | B2 * | 2/2004 | Amarasekera et al. | 524/495 |
| 6,773,773 | B2 | 8/2004 | Hauber | |
| 6,857,452 | B2 | 2/2005 | Quigley et al. | |
| 6,978,806 | B2 | 12/2005 | Glejbol et al. | |
| 7,055,551 | B2 | 6/2006 | Fraser et al. | |
| 7,302,973 | B2 | 12/2007 | Glejbol et al. | |
| 7,309,372 | B2 * | 12/2007 | Kahlbaugh et al. | 55/527 |
| 7,790,841 | B1 * | 9/2010 | Yandek et al. | 528/480 |
| 8,629,232 | B2 * | 1/2014 | Grant et al. | 528/125 |
| 2003/0032339 | A1 | 2/2003 | Bell et al. | |
| 2003/0047317 | A1 | 3/2003 | Powers | |
| 2005/0181203 | A1 | 8/2005 | Rawlings et al. | |
| 2007/0036925 | A1 | 2/2007 | Braad | |

(Continued)

FOREIGN PATENT DOCUMENTS

| | | |
|---|---|---|
| WO | WO 2008/113362 | 9/2008 |
| WO | WO 2008/119677 | 10/2008 |

(Continued)

OTHER PUBLICATIONS

International Search Report for International Application No. PCT/US/10/021102 dated Mar. 31, 2010.
International Search Report for International Application No. PCT/US/10/022796 dated Mar. 5, 2010.
International Search Report for International Application No. PCT/US/10/022797 dated Feb. 25, 2010.
International Search Report for International Application No. PCT/US/10/023131 dated Mar. 15, 2010.
International Search Report for International Application No. PCT/US/10/023129 dated Mar. 15, 2010.
International Search Report for International Application No. PCT/US/10/027764 dated May 4, 2010.

(Continued)

*Primary Examiner* — Camie Thompson
(74) *Attorney, Agent, or Firm* — Lynn B. Morreale

(57) ABSTRACT

Heat-resistant, high strength fibers useful in a wide range of end-use applications are prepared using a polymeric composition containing polyetherketoneketone and mineral nanotubes.

13 Claims, No Drawings

(56) References Cited

U.S. PATENT DOCUMENTS

| | | | | |
|---|---|---|---|---|
| 2007/0066741 | A1 | 3/2007 | Donovan et al. | |
| 2007/0106006 | A1 | 5/2007 | Cooper et al. | |
| 2007/0142569 | A1 | 6/2007 | Donovan et al. | |
| 2007/0148457 | A1 | 6/2007 | Wagner et al. | |
| 2007/0212963 | A1 | 9/2007 | Keep | |
| 2007/0243762 | A1 | 10/2007 | Burke et al. | |
| 2008/0009903 | A1 | 1/2008 | Schmieding et al. | |
| 2008/0063847 | A1 | 3/2008 | Chang et al. | |
| 2008/0139065 | A1 | 6/2008 | Amarasekera et al. | |
| 2008/0190507 | A1 | 8/2008 | Hardy | |
| 2008/0248201 | A1 | 10/2008 | Corkery et al. | |
| 2008/0255647 | A1 | 10/2008 | Jensen et al. | |
| 2008/0312387 | A1 | 12/2008 | El-Hibri et al. | |
| 2009/0138082 | A1* | 5/2009 | Reah et al. | 623/13.14 |
| 2010/0267883 | A1* | 10/2010 | Bhatt | 524/495 |
| 2011/0287225 | A1* | 11/2011 | Decarmine | 428/156 |
| 2011/0311811 | A1* | 12/2011 | Collette et al. | 428/373 |

FOREIGN PATENT DOCUMENTS

| | | |
|---|---|---|
| WO | WO 2010/085419 | 7/2010 |
| WO | WO 2010/088639 | 8/2010 |
| WO | WO 2010/091135 | 8/2010 |
| WO | WO 2010/091136 | 8/2010 |
| WO | WO 2010/107976 | 9/2010 |
| WO | WO 2010/111335 | 9/2010 |

OTHER PUBLICATIONS

International Search Report for International Application No. PCT/US/10/028417 dated May 11, 2010.

International Preliminary Report on Patentability for International Application No. PCT/US2010/022796 dated Aug. 2, 2011.

* cited by examiner

HIGH PERFORMANCE FIBERS

CROSS-REFERENCE TO RELATED APPLICATIONS

This application is a national stage application under 35 U.S.C. §371 of PCT/US2010/022796, filed Feb. 2, 2010, which claims benefit to U.S. Provisional Application No. 61/149,118, filed on Feb. 2, 2009, all of which are hereby incorporated by reference.

FIELD OF THE INVENTION

The invention relates to improved heat-resistant, high strength fibers useful in a wide range of end-use applications.

DISCUSSION OF THE RELATED ART

Fibers based on polyaryletherketones are known in the art, as evidenced by the following patents: U.S. Pat. No. 4,747,988; U.S. Pat. No. 5,130,408; U.S. Pat. No. 4,954,605; U.S. Pat. No. 5,290,906; and U.S. Pat. No. 6,132,872. Such fibers have been proposed for use in various end-use applications, particularly uses where the fibers or articles fabricated from such fibers are expected to be exposed to elevated temperatures for prolonged periods of time. For example, U.S. Pat. No. 4,359,501 and U.S. Pat. No. 4,820,571 describe industrial fabrics comprised of melt extrudable polyaryletherketone suitable for high temperature-high speed conveying applications in various industrial processes.

Further improvements in the properties of such fibers would, however, be of interest.

BRIEF SUMMARY OF THE INVENTION

In one aspect of the invention, a fiber comprising a polyetherketoneketone and mineral nanotubes is provided. In another aspect, a method of making such a fiber is provided, said method comprising heating said polymeric composition to a temperature effective to render said polymeric composition capable of flowing and extruding said heated polymeric composition through an orifice to form said fiber.

The fibers of the present invention have excellent thermal performance, chemical and solvent resistance (including hydrolysis resistance), abrasion resistance, ductility, strength, flame retardancy and flex and wear resistance and thus are useful in any application, device or process where a fiber or a fabric, yarn, mat or other product containing such fibers is required to resist abrasion and chemical attack while maintaining dimensionality stability at an elevated temperature.

DETAILED DESCRIPTION OF CERTAIN EMBODIMENTS OF THE INVENTION

Fibers in accordance with the present invention are advantageously manufactured using a polymeric composition comprised of a polyetherketoneketone and mineral nanotubes. The incorporation of the mineral nanotubes has been found to enhance the strength of the fibers, as measured by tensile strength and modulus, as well as the dimensional stability of the fibers (when the fibers are exposed to elevated temperatures). In addition, the presence of the mineral nanotubes is believed to have a nucleating effect, leading to modification of the crystalline structure of the polyetherketoneketone that may be beneficial to subsequent orientation of the fibers. The polyetherketoneketone exhibits better wetting of the mineral nanotube surfaces than other engineering thermoplastics and thus a high degree of adhesion between the polymer matrix and the mineral nanotubes is achieved (thereby permitting a higher loading of mineral nanotubes to further improve the strength of the fibers). Further, with polyetherketoneketone one can optimize the crystallinity and thereby the melting point (Tm) for the particular application, which cannot be done with polyetheretherketone.

The polyetherketoneketones suitable for use in the present invention may comprise (or consist essentially of or consist of) repeating units represented by the following formulas I and II:

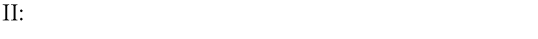

-A-C(=O)—B—C(=O)— (I)

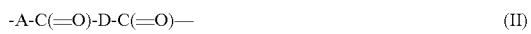

-A-C(=O)-D-C(=O)— (II)

where A is a p,p'-Ph-O-Ph-group, Ph is a phenylene radical, B is p-phenylene, and D is m-phenylene. The Formula I: Formula II (T:I) isomer ratio in the polyetherketoneketone can range from 100:0 to 0:100 and can be easily varied as may be desired to achieve a certain set of fiber properties. For example, the T:I ratio may be adjusted so as to provide an amorphous (non-crystalline) polyetherketoneketone. Fibers made from a polyetherketoneketone that has little or no crystallinity will generally be less stiff and brittle than fibers made from a more crystalline polyetherketoneketone. However, as crystallinity of the polyetherketoneketone is increased, the fiber strength generally also increases. In particular, fibers containing a partially crystalline polyetherketoneketone are capable of being oriented during drawing of the fibers post-extrusion so as to further strengthen the fibers. In one embodiment, the crystallinity of the polyetherketoneketone or mixture of polyetherketoneketones, as measured by differential scanning calorimetry (DSC) and assuming that the theoretical enthalpy of 100% crystalline polyetherketoneketone is 130 J/g, is from 0 to about 50%. In another embodiment, the polyetherketoneketone crystallinity is from about 10 to about 40%.

Polyetherketoneketones are well-known in the art and can be prepared using any suitable polymerization technique, including the methods described in the following patents, each of which is incorporated herein by reference in its entirety for all purposes: U.S. Pat. Nos. 3,065,205; 3,441,538; 3,442,857; 3,516,966; 4,704,448; 4,816,556; and 6,177,518. Mixtures of polyetherketoneketones may be employed.

In particular, the Formula I: Formula II ratio (sometimes referred to in the art as the T/I ratio) can be adjusted as desired by varying the relative amounts of the different monomers used to prepare the polyetherketoneketone. For example, a polyetherketoneketone may be synthesizing by reacting a mixture of terephthaloyl chloride and isophthaloyl chloride with diphenyl ether. Increasing the amount of terephthaloyl chloride relative to the amount of isophthaloyl chloride will increase the Formula I: Formula II (T/I) ratio.

In another embodiment of the invention, a mixture of polyetherketoneketones is employed containing polyetherketoneketones having different Formula I to Formula II ratios. For example, a polyetherketoneketone having a T/I ratio of 80:20 may be blended with a polyetherketoneketone having a T/I ratio of 60:40, with the relative proportions being selected to provide a polyetherketoneketone mixture having the balance of properties desired for the fibers when compounded with the mineral nanotubes.

Generally speaking, a polyetherketoneketone having a relatively high Formula I: Formula II ratio will be more crystalline than a polyetherketoneketone having a lower Formula I: Formula II ratio. The strength, stiffness/flexibility and other mechanical, thermal, thermomechanical and other properties of the fibers of the present invention can be varied as desired by controlling the crystallinity of the polyetherketoneketone or polyetherketoneketone mixture, thereby avoiding the need to blend in other polymers or plasticizers (which can lead to phase separation problems).

Suitable polyetherketoneketones are available from commercial sources, such as, for example, the polyetherketoneketones sold under the brand name OXPEKK by Oxford Performance Materials, Enfield, Conn., including OXPEKK-C (crystalline) and OXPEKK-SP (largely amorphous) polyetherketoneketone.

As mentioned previously, mineral nanotubes are a critical component of the polymeric composition utilized in the fibers of the present invention. As used herein, mineral nanotubes includes inorganic materials and carbon nanotubes that are cylindrical in form (i.e., having hollow tubular structures), with internal diameters typically ranging from about 10 to about 300 nm and lengths that typically are 10 to 10,000 times greater than the nanotube diameter (e.g., 500 nm to 1.2 microns). Generally, the aspect ratio (length to diameter) of the nanotubes will be relatively large, e.g., about 10:1 to about 200:1. The tubes need not be completely closed, e.g., they may take the form of tightly wound scrolls with multiple wall layers.

The nanotubes may be composed of known inorganic elements as well as carbon, including, but not limited to tungsten disulifide, vanadium oxide, manganese oxide, copper, bismuth, and aluminumsilicates. In one embodiment, the nanotubes are those formed from at least one chemical element chosen from elements of groups Ma, IVa and Va of the periodic table, including those made from carbon, boron, phosphorus and/or nitrogen, for instance from carbon nitride, boron nitride, boron carbide, boron phosphide, phosphorus nitride and carbon nitride boride. A blend of two or more different nanotubes mat be used.

Useful aluminumsilicates include imogolite, cylindrite, halloysite and boulangerite nanotubes as well as synthetically prepared aluminosilicate nanotubes. The surfaces of the nanotubes may be treated or modified as may be desired to alter their properties. Nanotubes may be refined, purified or otherwise treated (e.g., surface-treated and/or combined with other substances such that the other substances are retained within the nanotubes) prior to being combined with the polyetherketoneketone.

The amount of mineral nanotubes compounded with the polyetherketoneketone may be varied as desired, but generally the polymeric composition will comprise at least 0.01 weight percent, but no more than 30 weight percent, mineral nanotubes. For example, the polymeric composition may advantageously comprise from about 5 to about 20 weight percent mineral nanotubes. The polymeric composition may additionally be comprised of components other than the polyetherketoneketone and mineral nanotubes, such as stabilizers, pigments, processing aids, additional fillers, and the like. In certain embodiments of the invention, the polymeric composition consists essentially of or consists of polyetherketoneketone and mineral nanotubes. For example, the polymeric composition may be free or essentially free of any type of polymer other than polyetherketoneketone and/or free or essentially free of any type of filler other than mineral nanotubes.

The polymeric composition may be prepared using any suitable method, such as, for example, melt compounding the polyetherketoneketone and mineral nanotubes under conditions effective to intimately mix these components.

Fibers in accordance with the present invention may be prepared by adapting any of the techniques known in the art for manufacturing fibers from thermoplastic polymers, with melt spinning methods being especially suitable. For example, the polymeric composition (which may initially be in the form of pellets, beads, powder or the like) may be heated to a temperature effective to soften the composition sufficiently to permit it to be extruded (under pressure) through a die having one or more orifices of a suitable shape and size. Typically, a temperature that is approximately 20 to 50 degrees C. higher than the Tm (melt temperature) of the polyetherketoneketone will be suitable. A spinneret (containing, for example, 10 to 100 holes) may be used to produce an initial monofilament, where the fiber size is varied by adjusting screw, pump, and pump roll speeds and then subjecting the filament to a drawing operation to achieve the desired final fiber sizing. If desired, a heating cylinder for slowly cooling the spun fiber may be mounted just under the spinneret. The unstretched fibers obtained by melt-spinning may be subsequently hot stretched in, or under contact with, a heating medium. Stretching can be performed in multiple stages. For example, a melt spinning process may be utilized using an extrusion die, followed by quenching, fiber drawing over heated rolls and hot plate relaxation before winding the fiber onto a spool. The spinning temperature should be selected, based on the particular polyetherketoneketone used among other factors, such that a melt viscosity is achieved which is sufficiently low that high spinning pressures, clogging of the spinneret holes, and uneven coagulation of the polymeric composition are avoided but sufficiently high so as to avoid breakage of the extruded fiber stream exiting from the spinneret. Overly high spinning temperatures should also be avoided in order to reduce degradation of the polymeric composition.

The cross-sectional shape of the fiber may be varied as desired and may, for example, be round, oval, square, rectangular, star-shaped, trilobal, triangular, or any other shape. The fiber may be solid or hollow. The fiber may be in the form of a continuous filament such as a monofilament or in discrete, elongated pieces and two or more fibers may be spun into multifilaments such as yarns, strings or ropes. A fiber in accordance with the present invention can be twisted, woven, knitted, bonded, spun or needled into any of the conventional or known types of textile structures, including but not limited to woven and non-woven fabrics. Such structures may also include other fibers or materials in addition to the fibers of the present invention. For example, fibers comprised of polyetherketoneketone and mineral nanotubes may be interwoven with metal wires, polytetrafluoroethylene fibers, and/or fibers of other thermoplastics (in particular, fibers of engineering thermoplastics such as polyetheretherketones, polyetherketones, polyarylenes, aromatic polyethers, polyetherimides, polyphenylene sulphones, poly(p-phenylene-2,6-benzobisoxazole)(PBO), or the like). Coextruded fibers in accordance with the present invention may also be prepared containing two or more distinct polymeric compositions, with at least one of the polymeric compositions being comprised of a polyetherketoneketone and mineral nanotubes. The distinct polymeric compositions may be arranged in the form of a core-sheath or side-by-side structure, for example. The fibers in accordance With the present invention may be crimped to provide bulk in a woven, non-woven or knitted structure. The diameter of the fiber is not limited and may be adjusted or varied as needed to suit particular end-use applications. For example, the fiber may have a diameter of from about 50 microns to about 2 mm. Microfibers (i.e., fibers having sub-denier thicknesses) can also be fabricated in accordance with the present invention.

The fibers of the present invention may be readily adapted for use in a wide variety of end-use applications. For example, monofilaments in accordance with the invention may be utilized in open mesh conveyor systems or woven conveyor fabrics for paper drying, textile printing, fabric heat-setting, non-woven bonding, and food processing. Specific non-limiting examples where fabrics woven from the fibers of the present invention can be advantageously employed include belting for drying ovens, paper machine dryer section clothing, paper forming fabrics operating under hot, moist conditions (including exposure to high pressure steam impingement), filtration fabric (including filter bags to be used in hostile or harsh environments and hot gas filtration fabrics) and fabric for press-drying paper (high temperature press felts). Multifilaments or monofilaments comprised of fibers of the present invention may be employed in aerospace components, insulation products, thermoplastic and thermoset composites and narrow weaving. Various textile products requiring high flame resistance and low smoke generation and/or resistance to high temperatures and/or materials such as water, chemicals and solvents such as specialized (protective) clothing, shielding, geotextiles, agrotextiles, draperies, or upholstery fabrics may be manufactured using the fibers of the present invention. Combinations of monofilaments, multifilaments and staple fibers containing fibers in accordance with the invention can be used in filtration and chemical separation processes as well as in the manufacture of various types of strings, braids, brushes and cords. The fibers provided by the present invention can also be utilized in a number of medical applications, in particular where an article fabricated from or containing such fibers is to be implanted into or otherwise in contact with a human body. For example, the fibers may be used in composites for bone implants and the like as well as in reinforcement patches and braids for sutures and ligaments. In yet another application, the fibers of the present invention may be used to create a braided sleeve or overbraid that is expandable and flexible. The woven braiding can be placed over wiring, cable, piping, tubing or the like to guard against abrading and wear. The fibers of the present invention may also be used to manufacture implantable braided devices such as blood vessel stents or patches. Furthermore, fibers in accordance with the invention may be converted to other fiber products such as tow, staple fiber, staple spun yarn, and the like by adaptation or modification of conventional fiber processing methods.

EXAMPLES

Example 1

Compounding of Halloysite Filled PEKK

After drying in a forced air oven overnight at 120-130° C., Polyetherketoneketone with a high ratio of isophthalate (T/I=60/40) such as OXPEKK SP from Oxford Performance materials) is compounded with Halloysite nanotubes in various ratios to produce mixtures of 1, 3, 5 and 10% nanotubes by blending in a Killion 27 mm counter-rotating twin screw extruder with a speed of 20-60 RPM operating at temperatures of 315° C. (feed section) to 330° C. at the die. The unit is equipped with a strand die to produce ⅛" filaments that are cooled in a water bath and chopped ⅛" by ¼" pellets.

Example 2

Fiber Extrusion

The pellets produced in Example 1 are fed to a DSM Xplore microcompounder model 2005, fitted with a monofilament fiber die and a fiber take off device. The compounder is heated to 320° C. and the pellets fed to the extruder. Themonofilament is taken off by a fiber device with controlled speed/torque capabilities. Hot air at 150-250° C., preferably about 200° C., is used to slowly cool the filament. The air temperature is adjusted to maintain the proper melt strength while extruding the filament and winding it onto the take-up role. The use of a 60/40 T/I ratio PEKK allows the initial production of fibers with little or no crystallinity, as the rate of crystallization of this grade of PEKK is extremely slow. Furthermore the properties of the filaments can be optimized for the application by post annealing and drawing the fibers.

What is claimed is:

1. A fiber consisting of:

a) polyetherketoneketone, wherein the polyetherketoneketone is comprised of repeating units represented by formulas I and II:

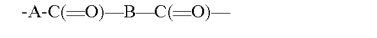

-A-C(=O)—B—C(=O)— I

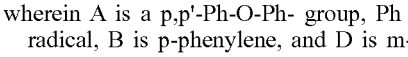

-A-C(=O)-D-C(=O)— II wherein A is a p,p'-Ph-O-Ph- group, Ph is a phenylene radical, B is p-phenylene, and D is m-phenylene and the isomer ratio of formula I:formula II (T:I) is about 60:40, and wherein the polyetherketoneketone has a crystallinity, as measured by DSC, of from about 10 to about 40% b) mineral nanotubes, and c) optionally, one or more additives selected from the group consisting of stabilizers and processing aids.

2. The fiber of claim 1, wherein said fiber is a monofilament.

3. The fiber of claim 1, wherein said fiber is a multifilament.

4. The fiber of claim 1, wherein said fiber has a diameter of about 50 microns to about 2 mm.

5. The fiber of claim 1, wherein said fiber is comprised of 0.01 to 30 weight percent mineral nanotubes.

6. A woven fabric comprising a plurality of fibers in accordance with claim 1.

7. A non-woven fabric comprising a plurality of fibers in accordance with claim 1.

8. A yarn comprising a plurality of fibers in accordance with claim 1.

9. A braid comprising a plurality of fibers in accordance with claim 1.

10. An implantable braided device comprised of a plurality of fibers in accordance with claim 1.

11. The fiber of claim 1 wherein said mineral nanotubes are inorganic nanotubes.

12. The fiber of claim 1 consisting of said polyetherketoneketone and mineral nanotubes.

13. A fiber consisting of:

a) polyetherketoneketone, wherein the polyetherketoneketone is comprised of repeating units represented by formulas I and II:

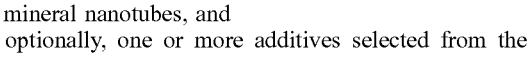

-A-C(=O)—B—C(=O)— I

-A-C(=O)-D-C(=O)— II wherein A is a p,p'-Ph-O-Ph- group, Ph is a phenylene radical, B is p-phenylene, and D is m-phenylene and the isomer ratio of formula I:formula II (T:I) is about 60:40, wherein the polyetherketoneketone is amorphous, b) mineral nanotubes, and c) optionally, one or more additives selected from the group consisting of stabilizers and processing aids.

* * * * *